United States Patent [19]

Bishop et al.

[11] Patent Number: 5,054,833

[45] Date of Patent: Oct. 8, 1991

[54] RELEASABLE OVERSHOT

[75] Inventors: Thomas R. Bishop, Houston, Tex.; Herschel E. Zirger, 21 Durham Dr., Conroe, Tex. 77302

[73] Assignee: Herschel E. Zirger, Conroe, Tex.

[21] Appl. No.: 617,952

[22] Filed: Nov. 26, 1990

Related U.S. Application Data

[63] Continuation of Ser. No. 462,343, Jan. 2, 1990, abandoned, which is a continuation of Ser. No. 242,039, Sep. 8, 1988, abandoned.

[51] Int. Cl.[5] ..... E21B 31/18

[52] U.S. Cl. ..... 294/86.3; 294/86.17

[58] Field of Search ..... 294/86.13, 86.17–86.21, 294/86.24–86.31; 166/98, 99

[56] References Cited

U.S. PATENT DOCUMENTS

| | | | |
|---|---|---|---|
| 1,033,531 | 7/1912 | Brown | 294/86.27 |
| 1,416,930 | 5/1922 | Ball | 294/86.2 |
| 1,433,146 | 10/1922 | Neilson | 294/86.3 |
| 1,455,499 | 5/1923 | Lang | 294/86.2 |
| 1,764,481 | 6/1930 | Watkins | 294/86.19 X |
| 1,775,291 | 9/1930 | Niles | 294/86.24 |
| 2,094,419 | 9/1937 | Shannon | 294/86.17 |
| 2,123,036 | 7/1938 | Bozeman | 294/86.2 |
| 3,152,829 | 10/1964 | Steele, Sr. | 294/86.18 |
| 3,950,021 | 4/1976 | Goldschild et al. | 294/86.3 X |
| 4,185,865 | 1/1980 | Taylor | 294/86.18 X |

*Primary Examiner*—Margaret A. Focarino
*Assistant Examiner*—Dean J. Kramer
*Attorney, Agent, or Firm*—Pravel, Gambrell, Hewitt, Kimball & Krieger

[57] ABSTRACT

A releasable overshot having independent slips, for retrieval of downhole tools and other equipment, which can be operated with a wireline, tubing, coiled tubing, or drill pipe string.

3 Claims, 5 Drawing Sheets

RELEASABLE OVERSHOT

This application is a continuation of application Ser. No. 462,343, filed Jan. 2, 1990, which is a continuation application of prior application Ser. No. 242,039 filed on Sept. 8, 1988, both now abandoned.

FIELD OF THE INVENTION

This invention is in the field of devices used to retrieve tools or other equipment from oil wells.

BACKGROUND

This invention is an improvement over U.S. Pat. Nos. 4,093,294 and 4,185,865. U.S. Pat. No. 4,093,294 discloses a releasable wireline spear which penetrates a fish in order to lift it. U.S. Pat. No. 4,185,865 discloses a releasable wireline overshot which includes a split collet lifting device.

It frequently happens in oil field work that a tool or some other piece of equipment must be retrieved from an oil well after being detached, either intentionally or inadvertently. The object to be retrieved could be a downhole tool or a piece of tubing or pipe. These would all commonly be referred to as "fish" during the retrieval operation. Many of the tools have a fishing collar at the top to facilitate retrieval. A broken or detached piece of tubing, however, would not.

Most tools in use to retrieve such fish are called "overshots" and they suffer from several disadvantages. The disadvantages generally appear when it is necessary to release a fish after attaching to it, but prior to pulling it out of the well. This can be necessary, for instance, when the fish is lodged in the casing or open hole and cannot be pulled free without overloading the wireline, tubing, coiled tubing, or drill pipe, or the hoisting equipment. The fish must then be released in order to get the overshot out of the well so that other retrieval methods can be attempted.

Releasing a fish from known overshots usually requires heavy jarring or the imparting of some rotational action. Rotational action can only be imparted if the overshot is attached to a tubing or drill pipe string instead of coiled tubing or a wireline. This is a distinct disadvantage because use of a tubing or drill pipe string requires a derrick, whereas a wireline or coiled tubing operation does not. A heavy jarring action can also cause damage to the fish, especially if it is delicate, such as in the case with most survey instruments. Known overshots which can be operated on a wireline without releasing via a heavy jarring action are not generally suited for retrieving a wide variety of fish. They may only be suitable for retrieving a fish having a fishing collar such as in U.S. Pat. No. 4,004,835, or neck, or they may be suited only for retrieving a limited range of fish diameters. Finally, they may be limited in the range of weights they are capable of supporting.

It is highly desirable to have an overshot which can operate on a wireline or coiled tubing or on a drill pipe or tubing string, engaging and releasing without rotation, which can retrieve heavy fish, and which can attach to fish with or without fishing collars and fish having a wide range of diameters. An overshot having these advantages can significantly reduce the number of different sizes and styles of overshots that must be available at a drilling or workover site.

SUMMARY OF THE INVENTION

The present invention is an overshot capable of being operated on either a wireline or coiled tubing or on a drill pipe or tubing string, engaging and releasing without rotation. It includes a housing which can be lowered over a fish. It also includes a grappling mechanism which rests atop the fish during the engagement procedure and attaches to the fish. The grappling mechanism has a body from which are hanging several independent slips. The slips have a plurality of sets of upward canted teeth which grip the fish. Each slip is pivoted at its upper end where it hangs from a pivot pin on the grappling mechanism body. This pivot point includes an elongated pivot hole which allows the top of the fish to shift inward or outward as required to align the slip teeth with different sizes and shapes of fish. Ramps on the inner surface of the housing mate with ramps on the outer surface of the slips to apply inward pressure on the slip teeth to grip the fish.

Selective engagement and disengagement of the fish is accomplished simply by pulling or slackening the wireline, coiled tubing, tubing or drill pipe. This pulling or slackening causes the rotation of a cam cylinder which is selectively engaged to and disengaged from the housing. This cam cylinder is permanently attached to the grappling mechanism body and therefore indirectly to the slips. Therefore, pulling and slackening the wireline, coiled tubing, drill pipe or tubing alternately attaches and releases the grappling mechanism from the fish.

DETAILED DESCRIPTION OF THE INVENTION

Throughout the Detailed Description and Claims, when the term "wireline" is used, it should be understood that this term encompasses the use not only of wireline but also of coiled tubing, drill pipe, or tubing at the option of the operator. The unique advantages of this invention are operative regardless of which of the above mentioned support means is selected.

Figure 1A:
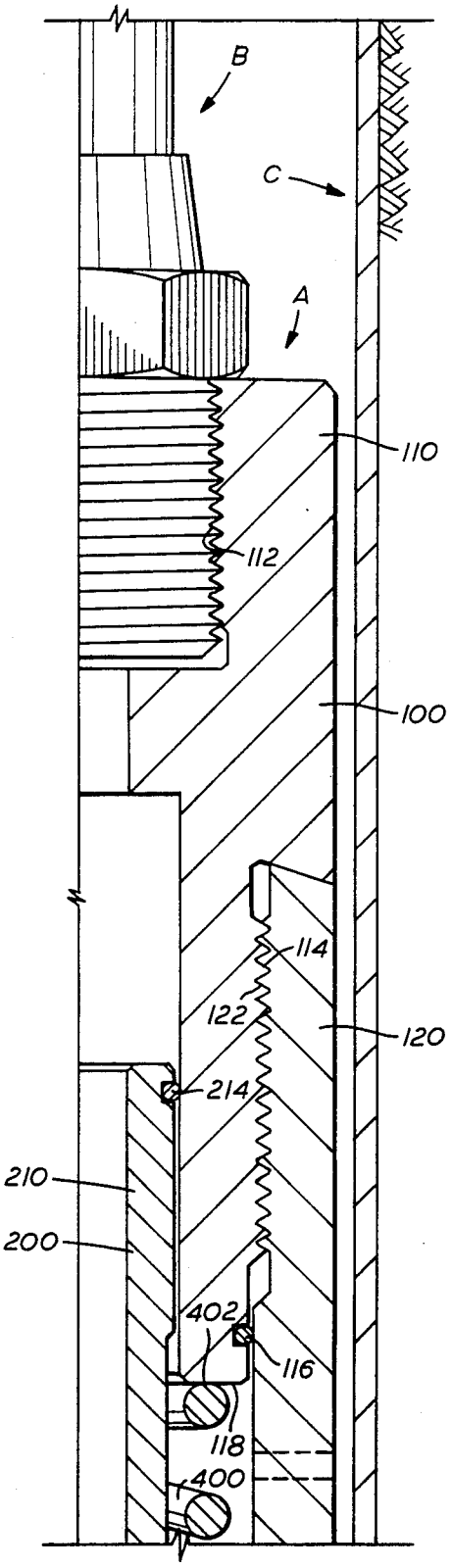
FIG. 1A is a sectional view of one side of the upper end of the overshot of the present invention.
Figure 1B:
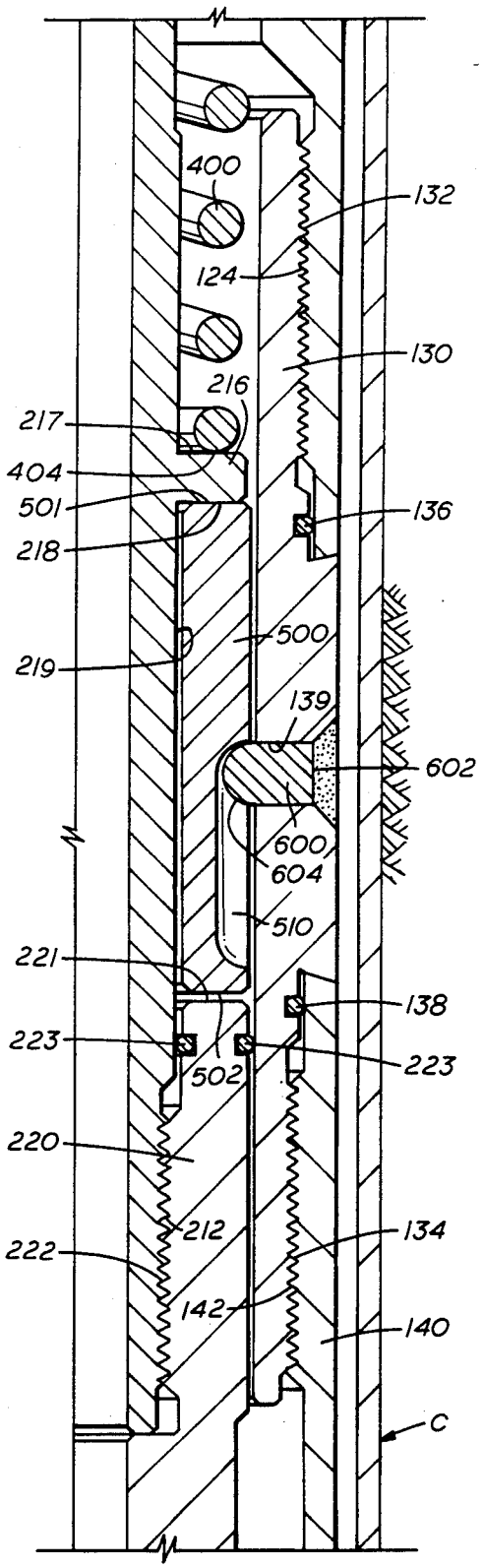
FIG. 1B is a sectional view of an upper intermediate portion of the overshot of FIG. 1A showing the cam cylinder and the cam follower pin in the released position.

Referring to FIG. 1A, releasable overshot A is connected by a threaded fitting to wireline B and suspended within well casing C. This invention is equally applicable to use in an open hole. Overshot housing 100 has at its upper end housing connector 110 which includes connector upper threads 112 to which wireline B is attached. Housing connector 110 is attached to housing upper barrel 120 by the engagement of housing connector lower thread 114 with upper barrel upper threads 122. Sealing off the gap between housing connector 110 and housing upper barrel 120 is housing connector seal 116. In FIG. 1B, housing upper barrel 120 is in turn connected to cam follower cylinder 130 by the engagement of upper barrel lower threads 124 with cam follower upper threads 132. The gap between cam follower cylinder 130 and housing upper barrel 120 is sealed by cam follower upper seal 136. Cam follower cylinder 130 has at its approximate longitudinal center at least one cam follower bore 139 into which cam follower pin 600 is permanently inserted. Permanent attachment of cam follower pin 600 to cam follower cylinder 130 can be by means of welding at cam follower pin outer end 602. The lower end of cam follower cylinder 130 is attached to the upper end of housing lower barrel 140 by the engagement of cam follower lower threads 134 with lower barrel upper threads 142. The gap between cam follower cylinder 130 and housing lower barrel 140 is sealed by cam follower lower seal 138.

Figure 1C:
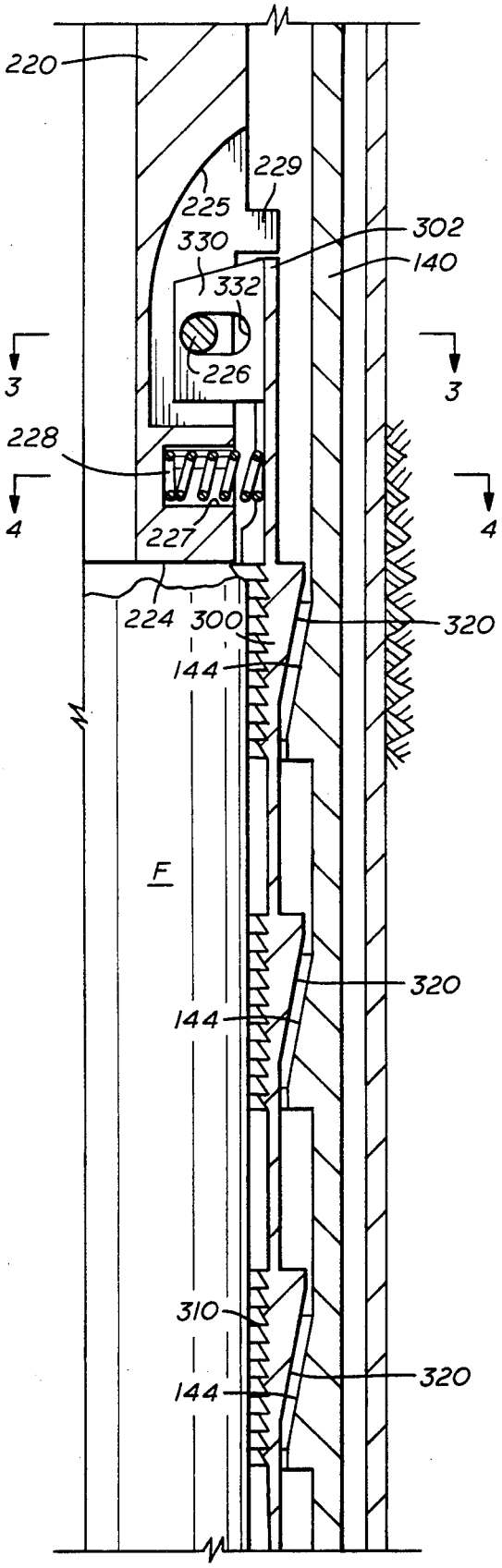
FIG. 1C is a sectional view of a lower intermediate portion of the overshot of FIG. 1A showing the pivot mechanism and the slip teeth in the released position.
Figure 1D:
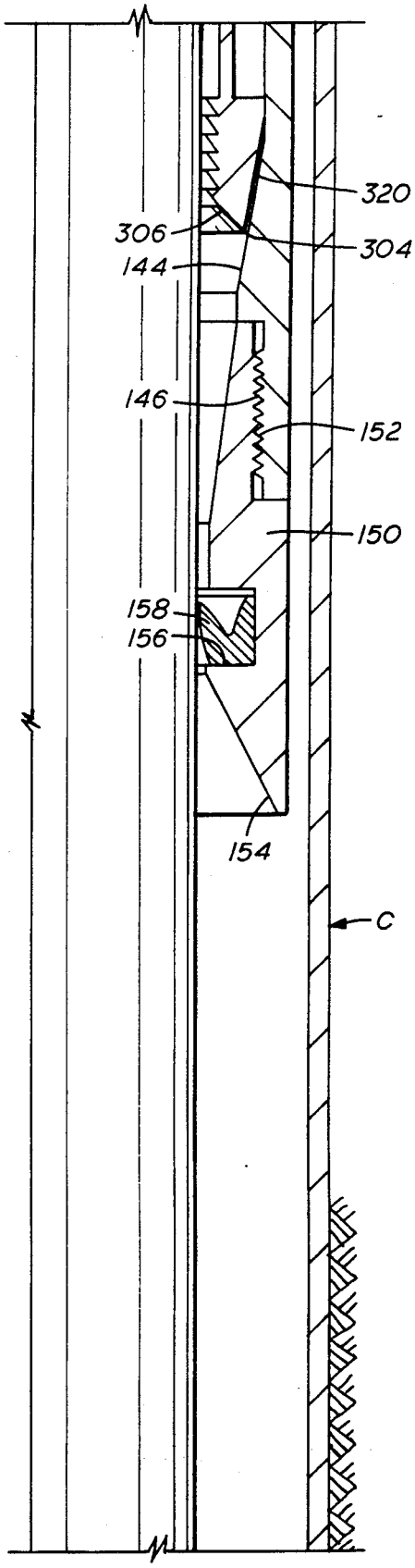
FIG. 1D is a sectional view of the lower end of the overshot of FIG. 1A.

In FIG. 1C, housing lower barrel 140 has on its interior surface a plurality of annular ramps 144 which, since housing lower barrel 140 is a cylinder, constitute a vertically spaced plurality of frusto-conical surfaces sloping outward having the smallest diameter at the lower end of each ramp 144 and the largest diameter at the upper end of each ramp 144. Housing lower barrel 140 is attached at its lower end to housing guide cylinder 150 by means of the engagement of housing lower barrel lower threads 146 with guide cylinder threads 152. Guide cylinder 150 has on the inside near its lower end guide cylinder ramp 154 which constitutes a frusto-conical surface sloping inward from bottom to top with its largest diameter at the bottom end of ramp 154 and its smallest diameter at the top end of ramp 154. Housing guide cylinder 150 also has seal groove 156 immediately above ramp 154, and held within seal groove 156 is guide cylinder seal 158.

Returning now to FIG. 1A, within overshot housing 100 is grappling mechanism body 200 which has as its upper component cam chassis 210. The gap between cam chassis 210 and housing connector 110 is sealed by cam chassis seal 214.

Referring to FIG. 1B, cam chassis 210 has at an intermediate vertical location spring retention shoulder 216 against which cam position spring 400 bears in biasing grappling mechanism body 200 downward with respect to overshot housing 100. It can be seen in FIG. 1A that the upper end 402 of cam position spring 400 bears upward against the lower end 118 of housing connector 110. Similarly, cam position spring lower end 404 bears downward against spring retention shoulder upper surface 217 on cam chassis 210. Still referring to FIG. 1B, cam cylinder 500 encircles cam chassis 210 at an intermediate vertical position immediately below spring retention shoulder 216. Cam cylinder 500 is restrained from upward movement by having its upper end 501 bear against spring retention shoulder lower surface 218. Cam cylinder 500 achieves a loose fit around the outer surface 219 of cam chassis 210. Cam chassis 210 is attached at its lower end to pivot chassis 220 by the engagement between cam chassis threads 212 and pivot chassis threads 222. The gaps between cam chassis 210 and pivot chassis 220 and between pivot chassis 220 and cam follower cylinder 130 are sealed by pivot chassis inner and outer seals 223. Cam cylinder 500 is restrained against movement in the downward direction, when required, by contact between cam cylinder lower end 502 and pivot chassis upper end 221.

Referring now to FIG. 1C, pivot chassis 220 has near its lower end a plurality of pivot grooves 225 cut vertically into its outer surface. Mounted horizontally near the perimeter of pivot chassis 220, bridging pivot grooves 225, are a plurality of pivot pins 226. Suspended from pivot pins 226 are a plurality of independent floating slips 300 by means of elongated pivot holes 332 formed substantially horizontally in pivot tabs 330. Pressing outward from pivot chassis 220 against independent floating slip 300 is slip spring 228 which is seated in slip spring bore 227. Arranged directly above slip upper end 302 and limiting the pivoting angle of slip 300 during assembly is pivot stop boss 229.

On the interior curved surface of slip 300 are a plurality of sets of upward angled slip teeth 310 which can, as will be explained later, engage the outer surface of the object to be retrieved, or fish F. Adjacent to slip lower end 304 is chamfer surface 306 which assists in the outward deflection of slip 300 upon entry by fish F. Spaced vertically along the outside surface of floating slip 300 are a plurality of ramps 320 which constitute segments of frusto-conical surfaces sloping outward from bottom to top and having the smallest radius at the lower end of each ramp 320 and the largest radius at the upper end of each ramp 320.

Figure 2:
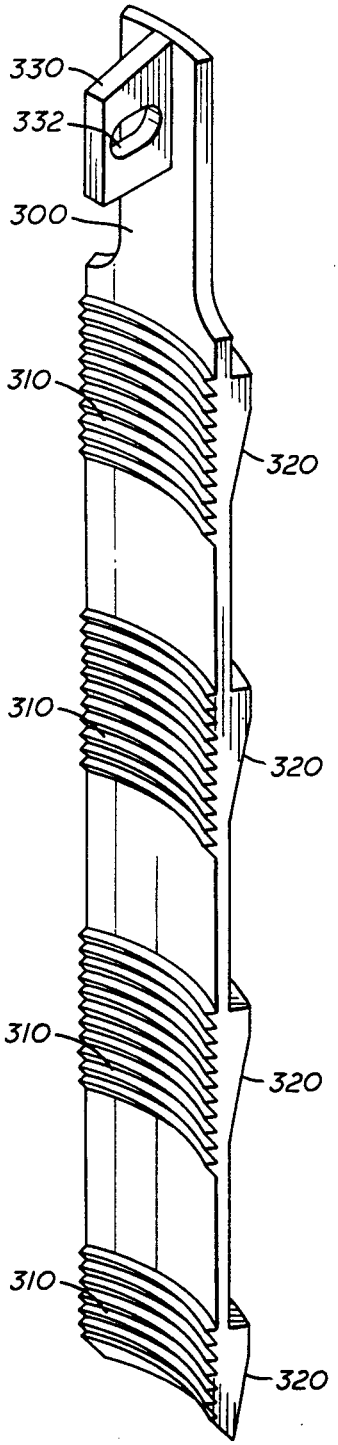
FIG. 2 is a perspective view of a slip of the present invention.

Referring now to FIG. 2, the configuration of each independent floating slip 300 can be seen. Slip 300 is a longitudinal segment of a cylinder, such as a pipe, which has machined on its inner surface a series of upwardly angled sets of teeth 310. Machined into the outer surface of floating slip 300 are a plurality of vertically spaced apart slip ramps 320 which slope outward from bottom to top. Floating slip 300 is suspended by means of pivot tab 330 from chassis 220. Pivot tab 330 extends inward from the inner curved surface of floating slip 300 and it includes substantially horizontal elongated pivot hole 332. It is through pivot hole 332 that pivot pin 226 passes. One important feature of the construction of floating slip 300 is the placement of slip ramps 320 with respect to the vertical position of slip teeth 310. One of the slip ramps 320 is positioned directly outward from each set of slip teeth 310. This relative vertical positioning of slip ramps 320 and slip teeth 310 acts in conjunction with the elongated shape of elongated pivot hole 332 to insure that the maximum number of slip teeth 310 engage the surface of the fish F.

Figure 3:
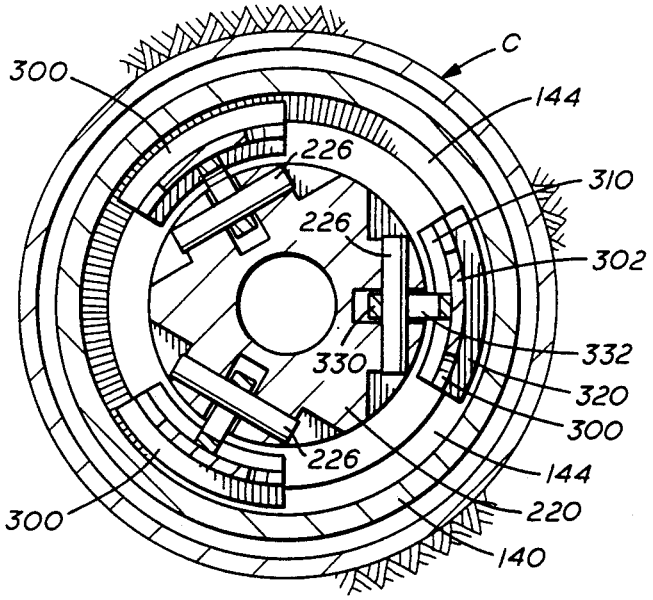
FIG. 3 is a transverse sectional view of the pivot mechanism of the present invention taken at the height of the pivot pin.

Referring now to FIG. 3, the equally spaced radial positioning of independent floating slips 300 can be seen. Overshot housing lower barrel 140 is shown positioned within well casing C. Annular housing ramp 144 is shown positioned below corresponding slip ramp 320 on each of the three slips 300. Slip teeth 310 are shown on the interior surface of slip 300 positioned to contact fish F at three equally spaced positions centered 120 degrees apart. Attached to slip 300 is pivot tab 330 having elongated pivot hole 332 through which pivot pin 226 extends. Since pivot pin 226 is permanently mounted horizontally in pivot chassis 220 floating slips 300 are thereby suspended from pivot chassis 220.

Figure 4:
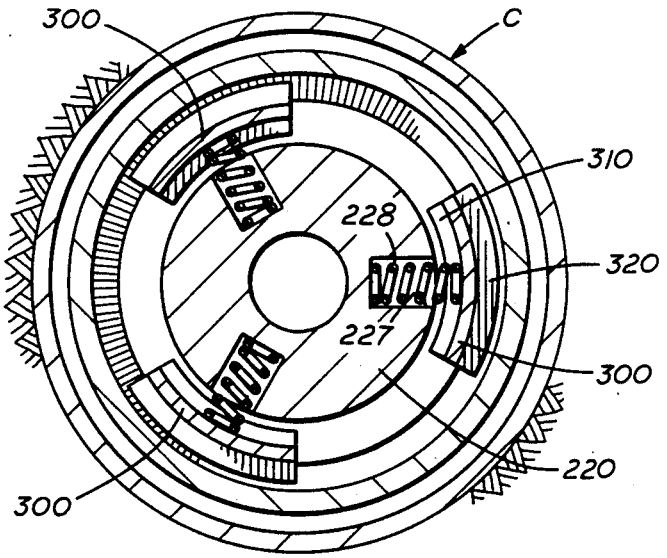
FIG. 4 is a transverse sectional view of the overshot of the present invention taken at the height of the slip springs.

Referring to FIG. 4, the positioning of slip springs 228 can be seen. Slip spring 228 is seated within slip spring bore 227 in pivot chassis 220. Slip spring bores 227 are equally spaced 120 degrees apart extending horizontally outward from the center of pivot chassis 220. The outer end of each slip spring 228 bears against floating slip 300 pushing it outward against overshot housing lower barrel 140.

Figure 5:
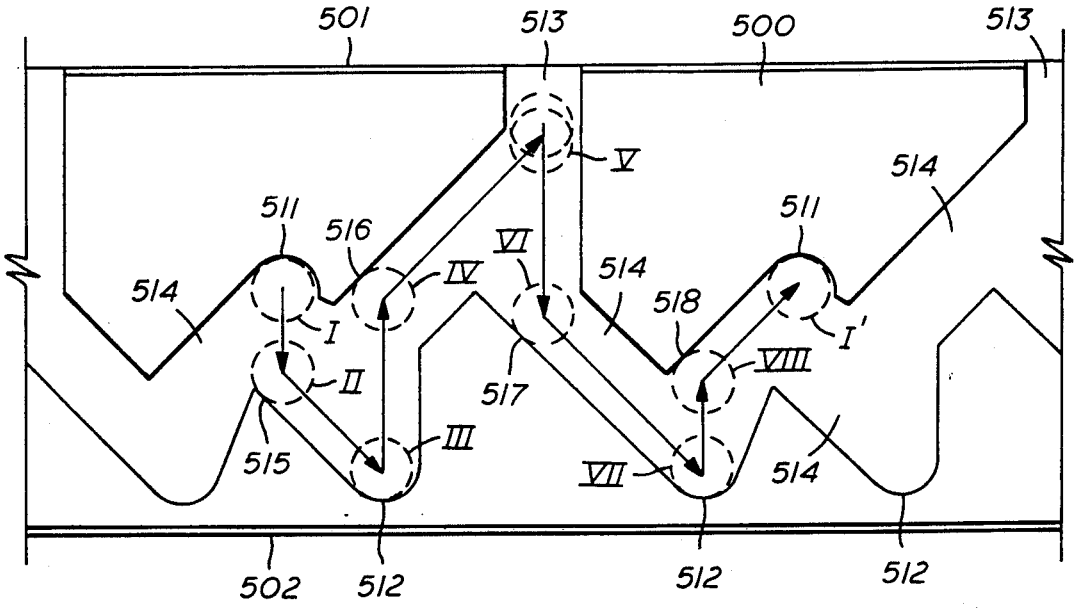
FIG. 5 is a 360° elevational view of the cam groove on the outer surface of the cam cylinder.

In FIG. 5, the outer cylindrical surface of cam cylinder 500 is shown as a flat projection for ease of explanation. FIG. 5 represents the complete outer surface of cam cylinder 500. A pair of cam follower pins 600 are located in diametrically opposite portions of cam groove 510. Cam groove 510 has two identical semi-circular portions, each of which has a downward turn 511 and an upwardly open slot 513 which is selectively engaged by one of the cam follower pins 600 to engage or release the fish F with the floating slips 300. Downward turns 511 are engaged by the pins 600 to lift the overshot when the fish F is released. The pins 600 move into the upwardly open slots 513 to enable the overshot to lift the fish F, as will be explained. In between the downward turns 511 and upwardly open slots 513 are upward turns 512 which provide intermediate positions between the two aforementioned lifting positions. Connecting downward turns 511, upward turns 512, and upwardly open slots 513 are sloping segments 514. The cam groove depicted here is followed by the cam follower pins 600 as will be explained later.

Figure 6:
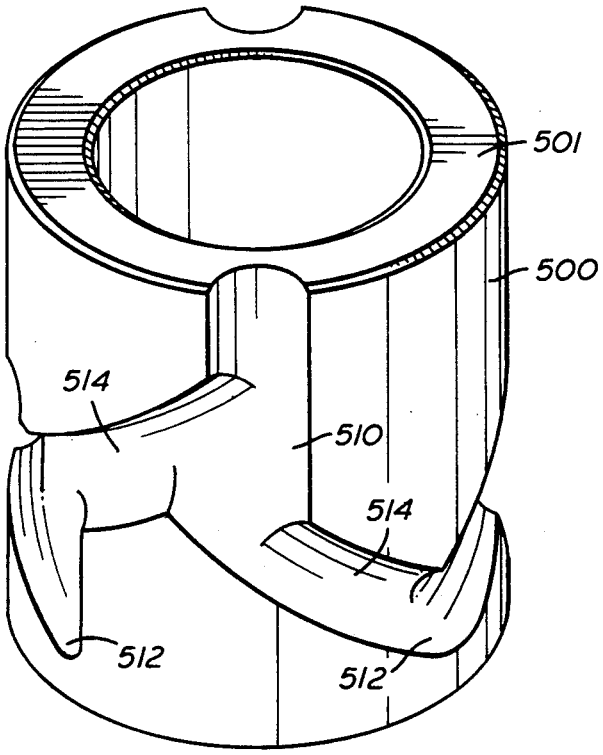
FIG. 6 is a perspective view of the cam cylinder of the present invention.
Figure 7A:
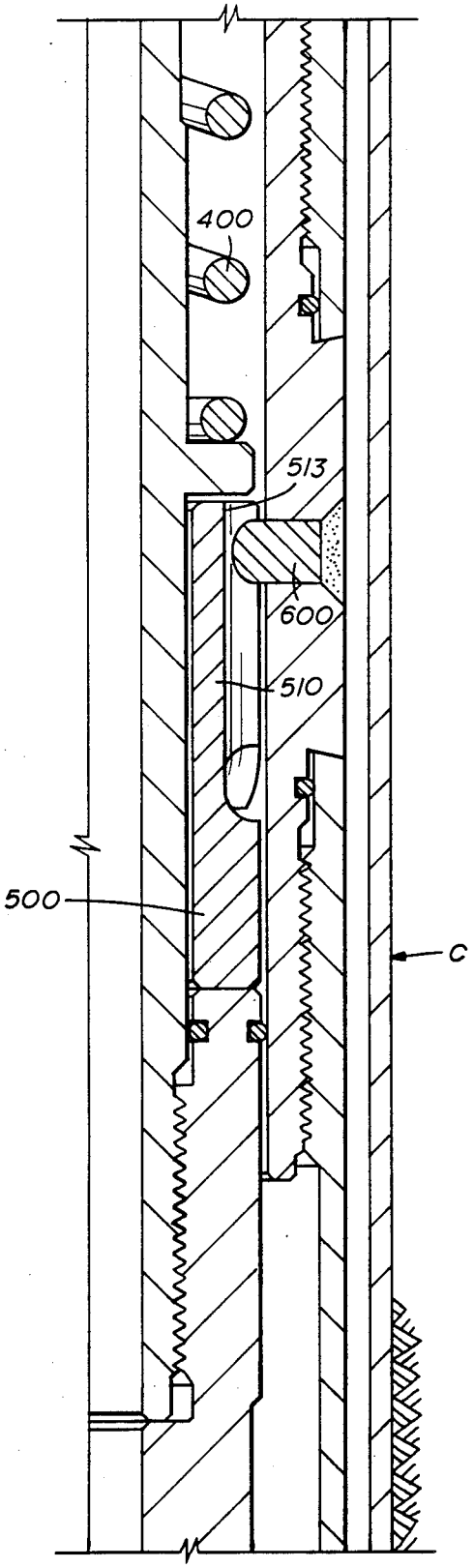
FIG. 7A is a sectional view of the cam cylinder and cam follower pin in the engaged position.
Figure 7B:
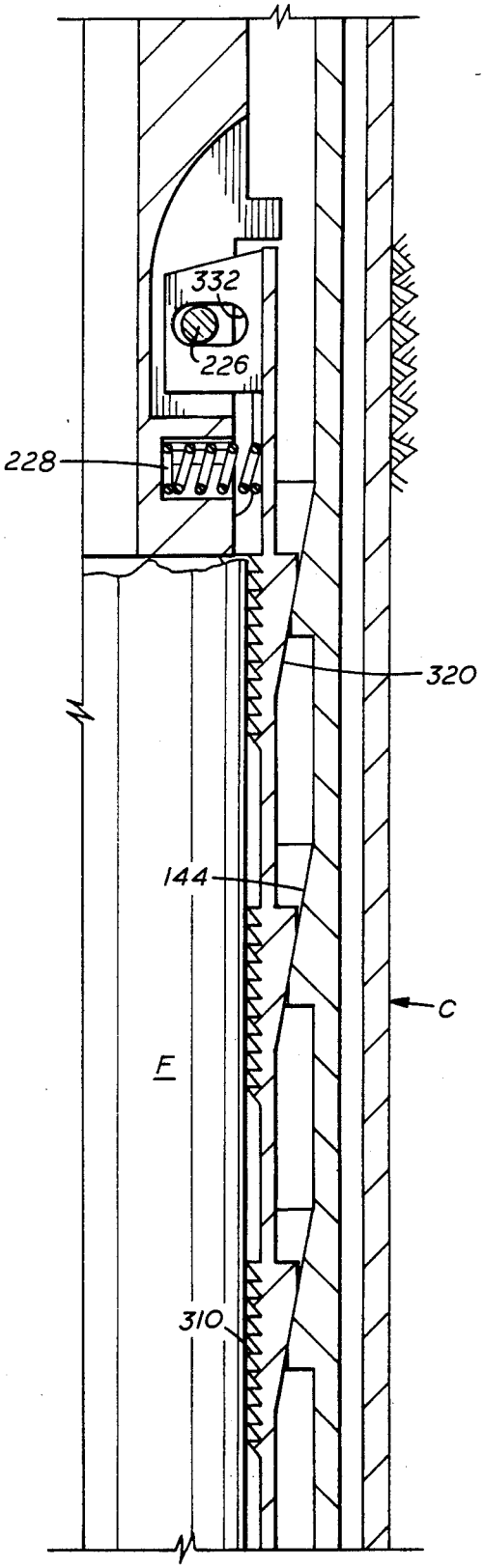
FIG. 7B is a sectional view of the pivot mechanism and the slip teeth in the engaged position.

FIG. 6 is a representation of the actual appearance of cam cylinder 500 showing cam groove 510.

OPERATION

In the operation of the overshot of the present invention, overshot A is lowered into casing C or into an open hole by means of wireline B which is attached to overshot housing 100 (FIGS. 1A and 1B). During initial lowering, the cam follower pins 600 are located at the turns 511 of the slot 510 (position I in FIG. 5) to support grappling mechanism body 200. During this lowering, floating slips 300 are suspended from pivot chassis 220 and are not engaged with fish F but are instead pressed outwardly against overshot housing lower barrel 140 by the action of slip springs 228. This alignment of all the parts is identical to the alignment used after a fish F has been released and the overshot is being withdrawn from the well such as may be required when fish F is too heavy for the overshot or the lifting equipment.

As the overshot is lowered, housing guide cylinder 150 drops over the upper end of fish F, being guided if necessary by guide cylinder ramp 154. The overshot is then lowered further allowing slips 300 to lower around the sides of fish F. This lowering ceases when pivot chassis lower end 224 contacts the upper end of fish F. Further slackening of wireline B allows overshot housing 100 to drop further, compressing cam position spring 400 and repositioning cam follower pins 600 from position I to position II and then to position III in cam groove 510 by reason of the rotation of cam cylinder 500, as will be more fully explained later.

Wireline B is then pulled upwardly, pulling on overshot housing 100, during which pivot chassis 220 remains pressed firmly against the upper end of fish F by cam position spring 400. Upon continuation of this upward pulling of wireline B, cam follower pins 600 move upwardly to position IV and then cause a rotation of the cam cylinder 500 to enable the pins to reach position V where they are aligned with the vertical slots 513. No rotation of the housing 100 or grappling mechanism 200 is necessary. While positioned in upwardly open slots 513, cam follower pins 600 do not bear any of the weight of grappling mechanism body 200, and the pins 600 may move upwardly in such slots 513 until the upward movement of the housings 100 is stopped by the teeth 310 engaging the fish F. When overshot housing 100 has been sufficiently raised by this pulling action, housing ramps 144 contact corresponding slip ramps 320, sliding along the inclined surfaces thereof and forcing independent floating slips 300 inward. This causes slip teeth 310 to contact the outer surface of fish F and align therewith as the upper end 302 of slip 300 floats to the position at which the maximum number of slip teeth 310 contact the surface of fish F. This can occur with slip 300 essentially vertical, as shown, where the fish F is a section of tubing as shown or slip 300 can be canted slightly to conform to the features of fish F. The independent floating nature of each slip 300 allows this overshot to engage a variety of external surface contours of fish F.

Continued pulling of wireline B causes housing ramps 144 to continue inward and upward pressure on slip ramps 320, forcing slip teeth 310 securely against or into the surface of fish F. Engagement between slip teeth 310 and the surface of fish F is sufficient to support the weight of fish F as it is then raised to the surface. During this lifting operation, cam follower pins 600 remain in upwardly open slots 513 of cam groove 510; therefore, all the weight of grappling mechanism body 200 and the fish F is supported by the wireline through the housing 100 and the housing ramps 144.

Referring to FIG. 5, the interaction between cam cylinder 500 and cam follower pin 600 will now be explained in more detail. Position I shown in dashed lines, is the position of each cam follower pin 600 during raising or lowering of the overshot without having a fish F engaged. When one pin 600 is in position I, the other pin 600 is in position I'. The following description, however, will trace the path of "each" pin 600 through positions I to VIII, it being understood that the other pin 600 is simultaneously moving through corresponding positions on the other side of cam cylinder 500. When it is desired to selectively engage floating slips 300 with fish F, wireline B is slackened, allowing overshot housing 100 to drop, causing each cam follower pin 600 to lower to position II where it contacts first lower deflection surface 515 in cam groove 510. Since cam cylinder 500 is free to rotate about cam chassis 210, when each cam follower pin 600 contacts surface 515, cam cylinder 500 rotates to the left as shown in FIG. 5 as each cam follower pin 600 continues to drop to the position shown as III. This is the lowest position of each cam follower pin 600. Wireline B is then tightened, pulling overshot housing 100 upwardly and thereby causing both cam follower pins 600 to rise to position IV where each pin contacts first upper deflection surface 516. As before, cam cylinder 500 is caused to rotate to the left as viewed in FIG. 5, and cam follower pins 600 continue upwardly to position V in upwardly open slots 513. It is at this point that floating slips 300 have been forced inwardly to contact fish F. Continued pulling on wireline B causes the overshot and fish F to be pulled to the surface while cam follower pins 600 remain essentially at position V.

If fish F must be released, wireline B is slackened, allowing each cam follower pin 600 to drop to position VI where it contacts second lower deflection surface 517 causing cam cylinder 500 to again rotate to the left. Each cam follower pin 600 proceeds to position VII in upward turn 512 until wireline B is again tightened. Upon tightening of wireline B, each cam follower pin 600 again rises to position VIII where it contacts second upper deflection surface 518. This causes cam cylinder 500 to again rotate to the left allowing each cam follower pin 600 to continue rising to position I' in downward turn 511. With each cam follower pin 600 in position I' the overshot can be raised to the surface without fish F, because the grappling mechanism body 200 is being supported by cam follower pins 600, and housing ramps 144 do not mate with slip ramps 320.

The performance of the releasable overshot of this invention is particularly enhanced by several of its features. The use of three independent floating slips 300, which can float about their pivot points, ensures that slip teeth 310 can conform to a great degree to the outer surface of fish F and ensure the greatest possible gripping power. This alignment is further enabled by the fact that each slip 300 has on its exterior surface a plurality of ramps 320 which ensure that inward pressure is maintained all along the slip rather than simply at one point, such as at the bottom of the slip as found in the prior art. The floating nature of each slip is enhanced by the use of slip springs 228 which move the upper end 302 of each slip 300 outward and which pivot slip lower ends 304 outward until each slip 300 makes contact with overshot housing lower barrel 140, facilitating the entry of fish F. The floating nature of the upper end 302 of each slip 300 is of course made possible by the use of an elongated pivot hole 332 rather than a round hole, or some equivalent non-floating simple pivot. Rather than using an elongated hole, this floating function could be achieved in an equivalent way by use of a slotted depression or a double articulated linkage. Another advantageous feature of this invention can be seen in FIGS. 1A and 1B where seals 116, 136, 138, 214 and 223 are used to prevent the entry of foreign material into that part of the mechanism which is occupied by cam cylinder 500 and cam position spring 400. Entry of foreign material such as sand, mud or metal chips into this area could clog cam groove 510 or prevent the free rotation of cam cylinder 500, or it could prevent the compression of cam position spring 400 by filling the cavity. Clogging cam groove 510 or preventing the rotation of cam cylinder 500 would prevent the selective engagement and release of fish F because lowering of cam follower pin 600 would not properly result in full rotation of cam cylinder 500. Similarly, prevention of the compression of cam position spring 400 would prevent cam follower pin 600 from lowering with respect to cam cylinder 500 as wireline B is slackened, again resulting in the failure of the selective engagement and release of fish F.

The drawings and description presented here represent the preferred embodiment of the present invention. Equivalent means can be devised by one skilled in the art to accomplish the function of this invention. To the extent that such means are equivalent to those shown here, it is intended that they be encompassed by the attached claims.

We claim:

1. An overshot for retrieving a downhole tool in a well, comprising:

a cylindrical housing adapted to be attached to a support member extending to the surface of the well;

a grappling mechanism body;

a plurality of elongated slip members having slip teeth thereon;

a slip ramp on an outwardly facing surface of each slip member;

a housing ramp on an inner surface of said housing, each housing ramp being positioned adjacent to an opposing slip ramp, said slip ramp movable relative to said housing ramp between an inward slip engaging position with the downhole tool and an outward slip release position;

tab means having an opening mounted on each slip member;

pin connection means disposed within said tab means opening for connecting each of said slip members independent of the other slip members to said grappling mechanism body for permitting each slip member to move translationally towards each other slip member into engagement with the downhole tool;

a cam cylinder engaged by a cam follower pin to operably connect said housing and said grappling mechanism body;

said cam cylinder rotatable relative to said grappling mechanism body;

said cam cylinder having a continuous groove on the exterior of said cam cylinder including a series of upwardly facing corners, downwardly facing corners, and upwardly open passages, connected by sloped passages, configured to provide alternating, restrained and unrestrained, upper positions for said cam follower pin; and said alternating upper positions alternate between an unrestrained position for engaging said slip members with the downhole tool and a restrained position for disengaging the slip member from the downhole tool.

2. The overshot of claim 1, wherein the cam follower pin is horizontally mounted with an outer end affixed to said housing and an inner rounded end protruding inwardly toward said cam cylinder.

3. An overshot for retrieving downhole tools, comprising:

a cylindrical housing adapted to attach to a wireline;

a grappling mechanism body within said housing, free to move axially relative to said housing;

first biasing means for continually urging said grappling mechanism body downward relative to said housing;

a plurality of pivot pins horizontally mounted in said grappling mechanism body;

a plurality of independent slips pivoted from said grappling mechanism body about said pivot pins;

a pivot tab vertically mounted near the top of each slip, having an elongated hole formed in said pivot tab, the major dimension of said hole being substantially horizontal, wherein said pivot pin passes through said hole, allowing said top of said slip to shift inward or outward as required to align said slip with a downhole tool to be retrieved;

a plurality of sets of upwardly canted slip teeth on an inward facing surface of each slip, contoured to substantially conform to the downhole tool;

a plurality of slip ramps on an outward facing surface of each slip, each ramp sloping outward from bottom to top, with one ramp positioned directly outward from each set of slip teeth;

a plurality of housing ramps on an inner surface of said housing, each housing ramp sloping outward from bottom to top, each housing ramp being positioned adjacent to an opposing slip ramp, such that upward motion of said housing relative to said slips causes said housing ramps to contact said slip ramps and force said slips inward into contact with the downhole tool, aligning said slip teeth uniformly with a surface of the downhole tool;

second biasing means for continually urging said slips outward from said grappling mechanism body into contact with said inner surface of said housing;

a cam cylinder mounted on the exterior of said grappling mechanism body so as to freely rotate about said grappling mechanism body without moving axially relative to said grappling mechanism body;

a continuous cam groove around the exterior surface of said cam cylinder, having sloping passages connecting alternating downward turns and upwardly open passages, said downward turns and upwardly open passages being separated by upward turns;

a cam follower pin protruding inward from said housing into said cam groove to selectively engage or disengage said housing with said cam cylinder by slackening or pulling upward on the wireline, causing said cam follower pin to selectively enter a downward turn on said cam groove to engage or to selectively enter an upwardly open passage to disengage said housing from said cam cylinder; and a plurality of seals between components of said housing, between components of said grappling mechanism body, and between said housing and said grappling mechanism body to exclude foreign material from a portion of the interior of said housing containing said cam cylinder and said first biasing means.

* * * * *